United States Patent [19]

Yuen et al.

[11] Patent Number: 5,033,753

[45] Date of Patent: Jul. 23, 1991

[54] METHOD OF PLAYING A STRATEGIC BOARD GAME

[76] Inventors: Tom Yuen; Jason T. Yuen; Maureen C. Yuen; Erica K. Yuen; Craig B. Yuen, all of Princeton-Hightstown Rd., Princeton Junction, N.J. 08550

[21] Appl. No.: 607,585

[22] Filed: Nov. 1, 1990

[51] Int. Cl.[5] ..... A63F 3/00

[52] U.S. Cl. ..... 273/261; 273/262; D21/24

[58] Field of Search ..... 273/260, 261, 262, 255; D21/24

[56] References Cited

U.S. PATENT DOCUMENTS

| | | | |
|---|---|---|---|
| De. 231,846 | 6/1974 | Tchou | 273/260 |
| 1,210,854 | 1/1917 | Schroer | 273/262 |
| 4,506,893 | 3/1985 | Perry | 273/260 |
| 4,856,789 | 8/1989 | Carlson | 273/261 |

FOREIGN PATENT DOCUMENTS

| | | | |
|---|---|---|---|
| 430249 | 6/1935 | United Kingdom | 273/255 |
| 2191952 | 12/1987 | United Kingdom | 273/260 |

*Primary Examiner*—Benjamin Layno

[57] ABSTRACT

A strategic board game is disclosed. Two players, utilizing fifteen playing pieces each, engage in a battle on an original game board. The object of the game is for the King and his Warriors to defeat the Wizard and his Beasts; and vice versa. The game board consists of 108 alternately shaded squares. A meadow, a castle, a cave and two sets of tunnel ingresses/egresses are delineated on said squares. The movement of the above playing pieces on the game board must be in accordance with an original set of rules. The game ends when either of the King or Wizard is killed. The rules of the game, the thirty playing pieces and their movement abilities, and the game board together form a novel and challenging strategy game similar to the traditional game of Chess.

2 Claims, 20 Drawing Sheets

Legend:

| | | |
|---|---|---|
| A - Archer | K - King | O - Ogre |
| C - Chimera | L - Lord | S - Soldier |
| D - Dragon | M - W.Maiden | U - Unicorn |
| G - Gryphon | N - Knight | W - Wizard |

Legend:
I - initial location of the King or Wizard
f - choice of final moves
h - additional choice of final moves after 13 opponents are killed Legend:
I - initial location of the Lord or Dragon f - choice of final moves Legend:
I - initial location of the Archer or Chimera f - choice of final moves Legend:
I - initial location of the Knight or Gryphon f - choice of final moves Legend:
I - initial location of the Warrior Maiden or the Unicorn
f - choice of final moves Legend:

O - initial location of the Ogre
S - initial location of the Soldier
t - choice of Ogre final moves awaiting transformation
y - choice of Soldier final moves awaiting promotion
q - choice of Ogre final moves
r - choice of Soldier final moves Legend:
G - initial location of Gryphon entering tunnel
g - choice of Gryphon final moves
L - initial location of Lord exiting tunnel
b - choice of Lord final moves Legend:

| | | |
|---|---|---|
| A - Archer | K - King | O - Ogre |
| C - Chimera | L - Lord | S - Soldier |
| D - Dragon | M - W.Maiden | U - Unicorn |
| G - Gryphon | N - Knight | W - Wizard |

"Wizard's Move"

"King's Move"

Legend:

D - Dragon W - Wizard
K - King
L - Lord
O - Ogre

"Wizard's Move"

"King's Move"

Legend:

A - Archer W - Wizard
C - Chimera
K - King
O - Ogre

"Wizard's Move"
(no beasts remain)

"King's Move"
(no warriors remain)

Legend:
G - Gryphon
K - King
N - Knight
W - Wizard

"Wizard's Move"
(no beasts remain)

"King's Move"
(no warriors remain)

Legend:
K - King
M - Warrior Maiden
U - Unicorn
W - Wizard

"Wizard's Move"

"King's Move"

Legend:

A - Archer
C - Chimera
D - Dragon
K - King
L - Lord
W - Wizard

"Wizard's Move"

"King's Move"

Legend:

D - Dragon
G - Gryphon
K - King
L - Lord
N - Knight
W - Wizard

"Wizard's Move"

"King's Move"
(no warriors remain)

Legend:
D - Dragon U - Unicorn
K - King W - Wizard
L - Lord
M - Warrior Maiden

"Wizard's Move"

"King's Move"

Legend:
G - Gryphon
K - King
N - Knight
W - Wizard

"Wizard's Move"
(no beasts remain)

"King's Move"
(no warriors remain)

Legend:
G - Gryphon U - Unicorn
K - King W - Wizard
M - Warrior Maiden
N - Knight "Wizard's Move"

"King's Move"

Legend:

A - Archer N - Knight
C - Chimera W - Wizard
G - Gryphon
K - King

"Wizard's Move"

"King's Move"

Legend:
A - Archer
C - Chimera
K - King
W - Wizard

METHOD OF PLAYING A STRATEGIC BOARD GAME

BACKGROUND OF THE INVENTION

The invention disclosed hereinafter is an intellectual game where each move of a playing piece generates varying combinations of alternative countermoves. It may be categorized with the traditional game of Chess. However, when a detailed comparison is made, the novelty of the present invention is clearly evident. For example, the game board differs by:

a. the number and arrangement of squares used,
b. the existence of a castle, a cave, and two tunnels, and
c. the physical appearance of the shaded sqares: predominantly light and dark greens representing an open meadow; shades of gray in the castle, cave and tunnel ingress/egress areas.

Furthermore, the playing pieces differ by:

a. the number of playing pieces,
b. the starting position of the playing pieces,
c. the names and shapes of the playing pieces with the exception of the name "King", and
d. the movement of each playing piece as described hereinafter by the "Abilities of the Playing Pieces" and the "Rules of the Game".

The novelty of the present invention lies within the concepts of the game playing rules, the number and types of playing pieces, the elements of the game board and the combined balance of all of the aforementioned.

SUMMARY OF THE INVENTION

It is an object of the present invention to provide a novel intellectual war game.

Another object of the present invention is to provide a war game where "strategic" movements of playing pieces on a game board will create numerous and unobvious possible outcomes of the game.

Another object of the present invention is to create a war game with a setting and playing piece characters that invite role playing by the participants.

The present invention is a two player strategic war game comprised of an original game board, thirty playing pieces, and rules governing the movement of the playing pieces on the game board. One player assumes the role of a King and fourteen Warriors while the other player assumes the role of an evil Wizard and fourteen Beasts. The movement abilities of the opposing playing pieces are matched to create an equality of strength at the beginning of each game.

Players take alternating turns moving their respective playing pieces on the game board in accordance with the rules. As the players move their playing pieces, they will inevitably kill opposing playing pieces. Accordingly, the "Power Level" of each player will diminish proportionally with their armies—which may have a bearing on the final outcome of the game.

The game ends when (a) the King or Wizard is killed; (b) there is a "jeopardy" win; (c) there is a forfeit; or (d) a draw is mutually agreed upon.

DESCRIPTION OF THE PREFERRED EMBODIMENTS

Referring to the Figures, the preferred embodiments of the present invention will be described in detail. The game of the present invention can be played by anyone with the ability to understand and comprehend the concepts and the rules of the game. As will be explained in more detail hereinafter, the game of the present invention will also require the use of equipment.

In this two player strategic game, a battle between an imaginary King and an evil Wizard set in the dark ages of western Europe has been created. Both players begin by mutually agreeing upon which role, the King or the Wizard, each will assume. The object of the game is for the King to destroy the Wizard; and vice versa.

Equipment Required

Figure 1:
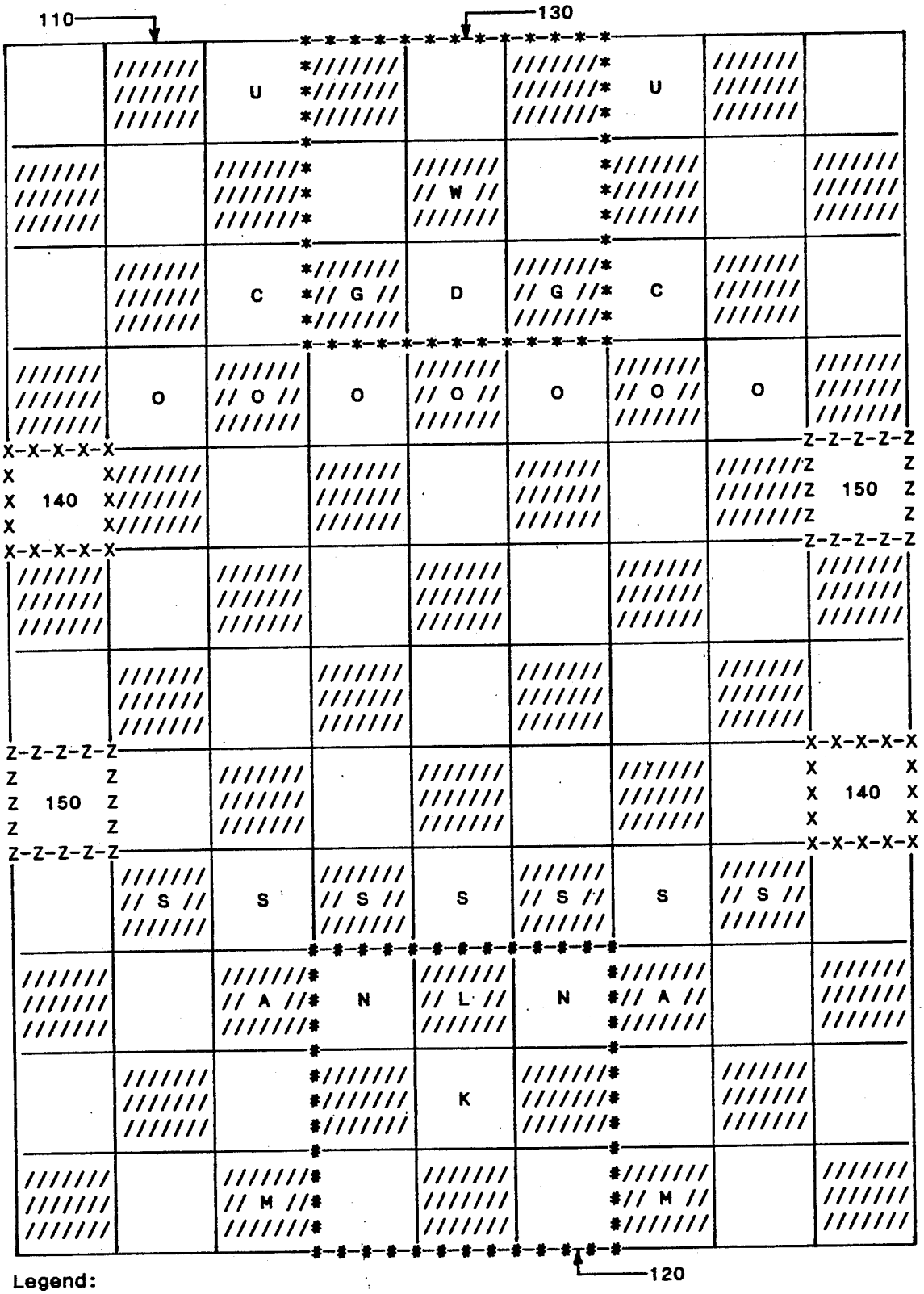
FIG. 1 is a plan view illustration of the game board and the starting position of the playing pieces.

The game utilizes a game board 110 as illustrated in FIG. 1. The game board represents a battlefield and is comprised of one hundred and eight (108) alternately shaded squares. The said squares are arranged in a nine square by twelve square rectangle. Nine of the said squares (arranged three by three) located and centered off one of the short sides of the game board are delineated 120 to represent the King's castle. Another nine of the said squares (arranged three by three) located off the opposite short side of the game board are delineated 130 to represent the Wizard's cave. Two of the said squares located diagonally opposite each other off the long sides of the game board are delineated 140 to represent the ingresses/egresses to an imaginary tunnel. Another two of the said squares, symmetically opposite the aforementioned tunnel, are similarly located and delineated 150 to represent an imaginary second tunnel separate from the first tunnel. All of the above are integral elements of the game board and the present invention.

The game of the present invention also requires a total of thirty (30) playing pieces. Fifteen (15) of the said playing pieces, of six various shapes and one color, are used to represent a King of his Warriors. The remaining fifteen (15) playing pieces, of six various shapes and one color (all of which differ from the King and his Warriors), are used to represent a counterpart Wizard and his Beasts. The playing pieces and their respective counterparts are further identified as follows:

| The King and his Warriors | The Wizard and his Beasts |
|---|---|
| one(1) - King | one(1) - Wizard |
| one(1) - Lord | one(1) - Dragon |
| two(2) - Archers | two(2) - Chimeras |
| two(2) - Knights | two(2) - Gryphons |
| two(2) - Warrior Maidens | two(2) - Unicorns |
| seven(7) - Soldiers | seven(7) - Ogres |

The materials of construction for all of the above required equipment can be of any moldable material such as plastic, wood, cardboard, metal, or ceramics. The playing pieces are molded into shapes described by their names, some of which are described hereinafter, or any other icons that will serve to identify the individual playing pieces. The game board can be fabricated by any means that will provide a playing surface similar to the illustration in FIG. 1. In the case of software programs, standard computer software materials, computers, video display terminals and other computer peripheral equipment required to run the software programs will be used.

Abilities of the Playing Pieces

Figure 2:
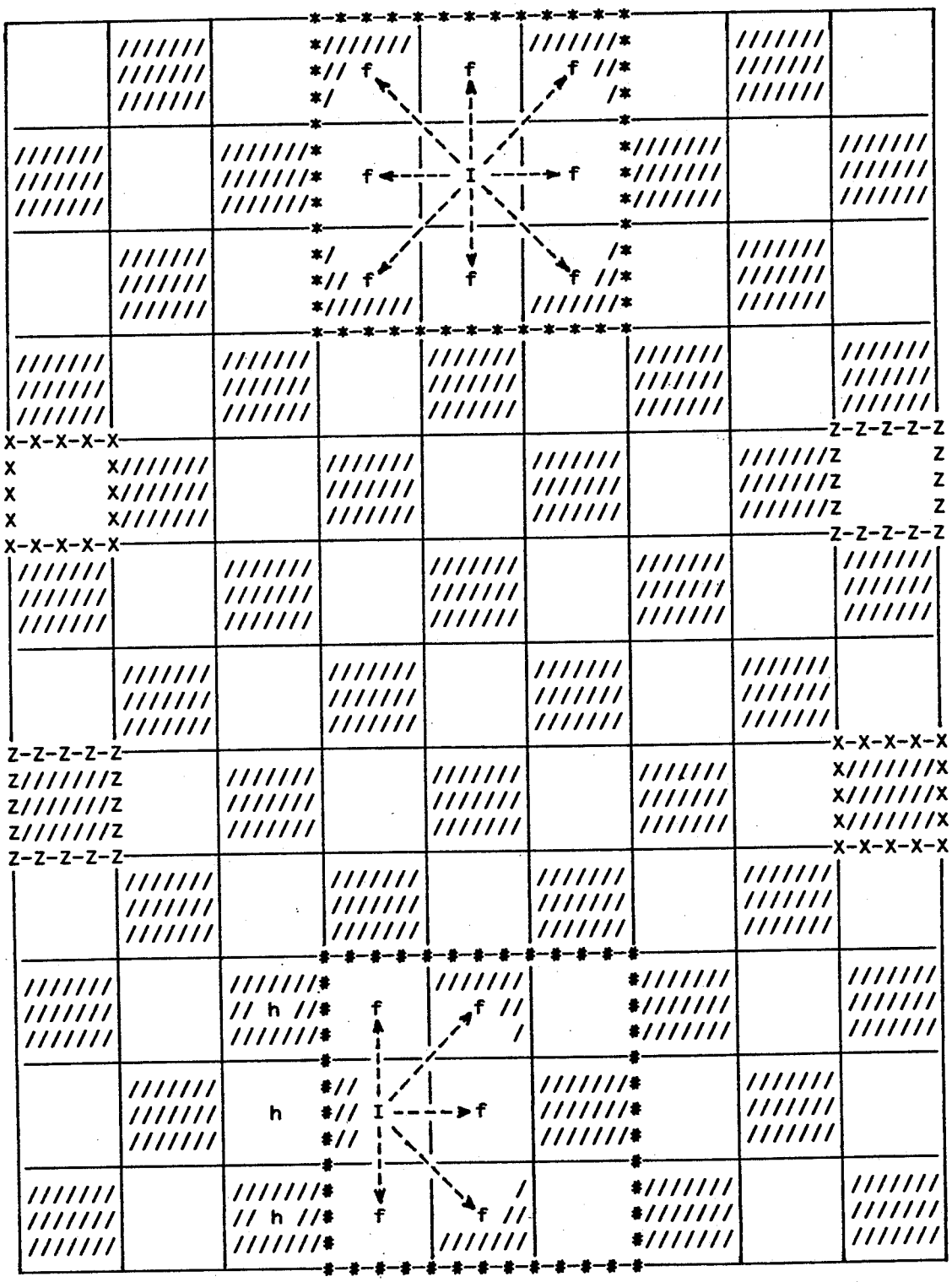
FIG. 2 is a plan view illustration of the movement abilities of the King and its counterpart, the Wizard.

King and Wizard: Despite their powers, the King and the Wizard possessed limited physical abilities in combat. They instead, relied heavily on their strategic abilities in directing their armies to victory. As illustration in FIG. 2, the King and the Wizard may move one (1) square in any direction. However, their movements are limited to their respective castle or cave until such time that thirteen of their opponent's army has been destroyed.

Figure 3:
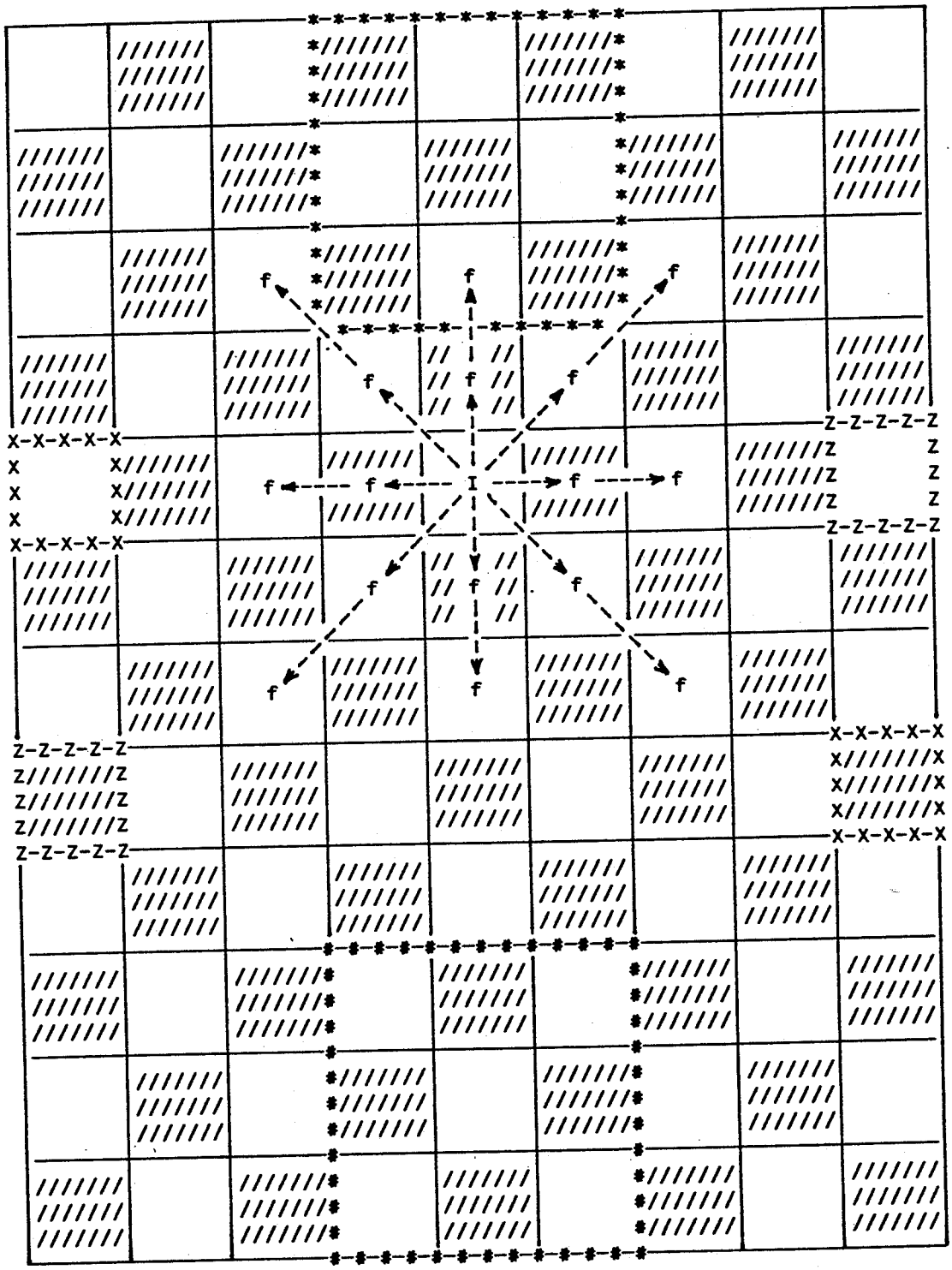
FIG. 3 is a plan view illustration of the movement abilities of the Lord and its counterpart, the Dragon.

Lord and Dragon: The Lord was the King's general on the battlefield. His courage and skills in weaponry and the martial arts was second to none. The Dragon, with its immense tail and poisonous breath, left an eerie path of destruction. It was a monstrous beast which shook the earth in battle. As illustrated in FIG. 3, the power of the Lord and the Dragon are reflected in their ability to move (without jumping over other playing pieces) one (1) or two (2) squares on a straight line in any direction.

Figure 4:
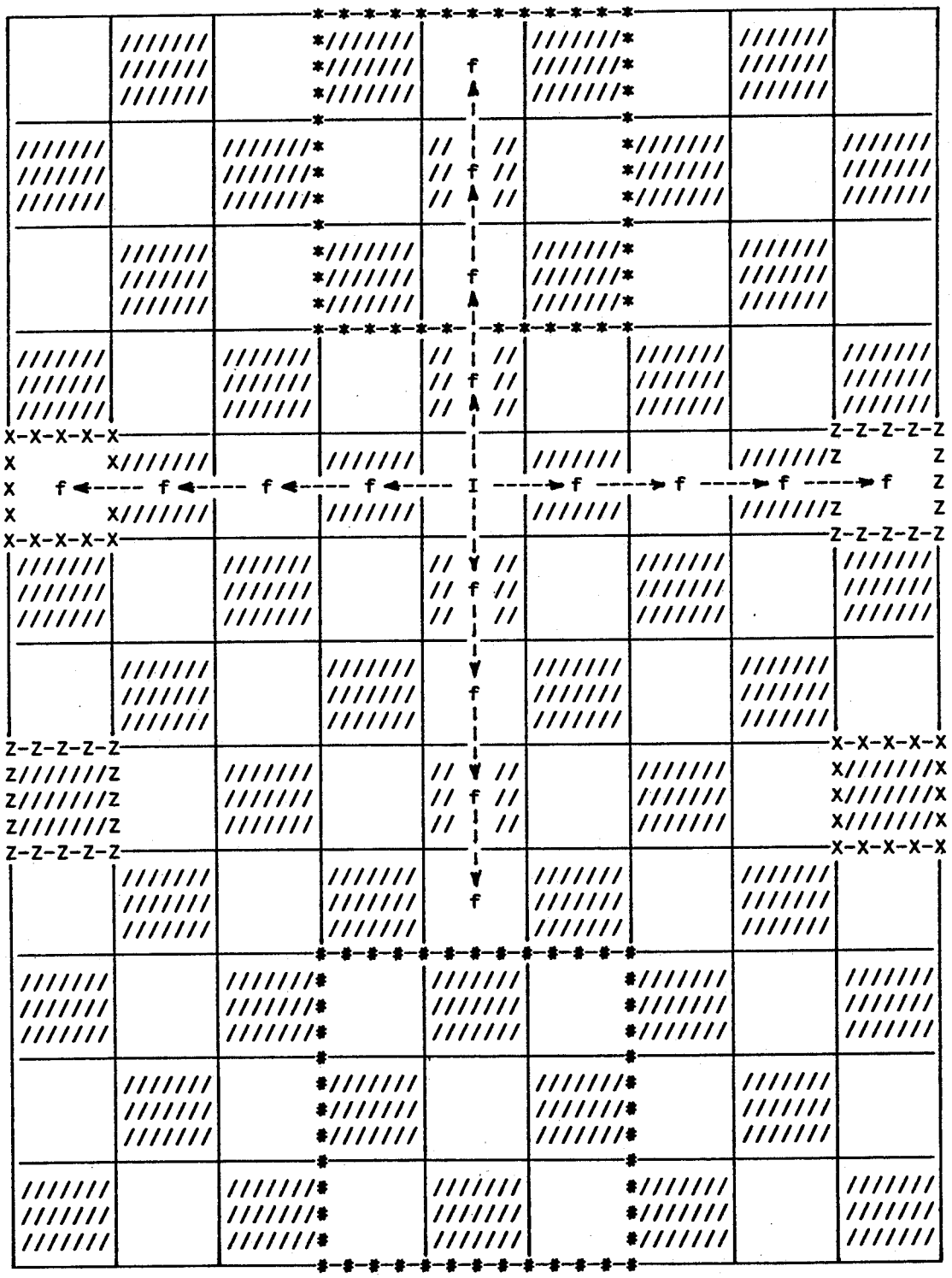
FIG. 4 is a plan view illustration of the movement abilities of an Archer and its counterpart, the Chimera.

Archer and Chimera: The Archers were respected for the amazing accuracy they displayed with their bows and arrows. The thought of a slow painful death from their poisonous arrow heads made these mere mortals much feared adversaries. The Chimera was a grotesque beast composed of a lion in the front, a dragon in the rear, and a fire breathing she-goat in the center. It was unmerciful. As illustrated in FIG. 4, the Archer and the Chimera both have the ability to move (without jumping over other playing pieces) either one (1), two (2), three (3) or four (4) squares in any horizontal or vertical direction only.

Figure 5:
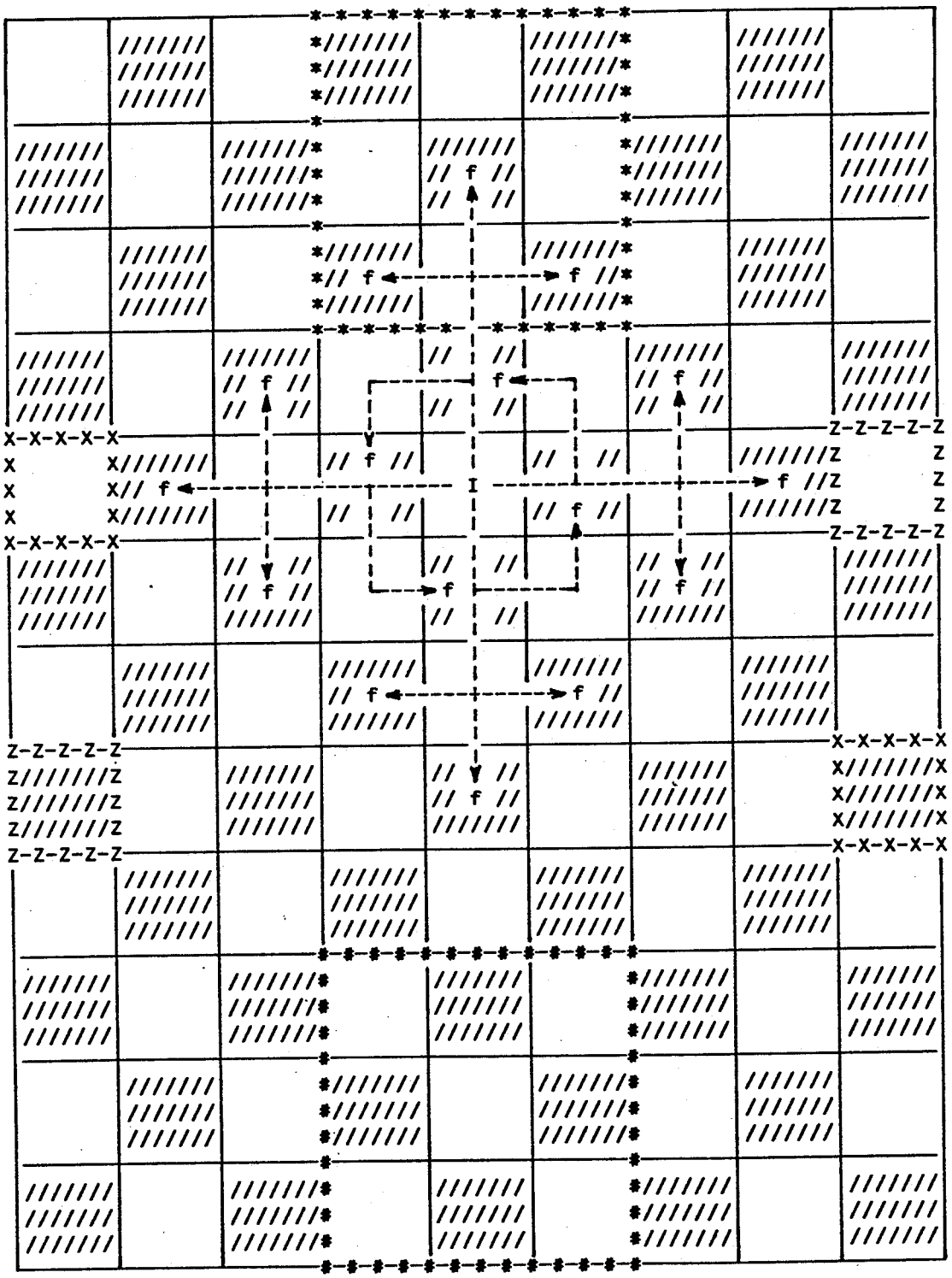
FIG. 5 is a plan view illustration of the movement abilities of a Knight and its counterpart, the Gryphon.

Knight and Gryphon: The Knight was a strong and highly skilled fighter. In combat, he was brutal and feared nothing. The Gryphon was a compound animal with the head, wings, forelegs and claws of an eagle and the body, hind legs and tail of a lion. It was believed that the Gryphon was as big as two lions with talons the size of an oxen's horns. It had the strength of eight lions and one hundred eagles. As illustrated in FIG. 5, the Knight's and the Gryphon's deadliness are visible in their ability to move three (3) squares in any continuous horizontal and/or vertical direction and *over* any other playing piece(s).

Figure 6:
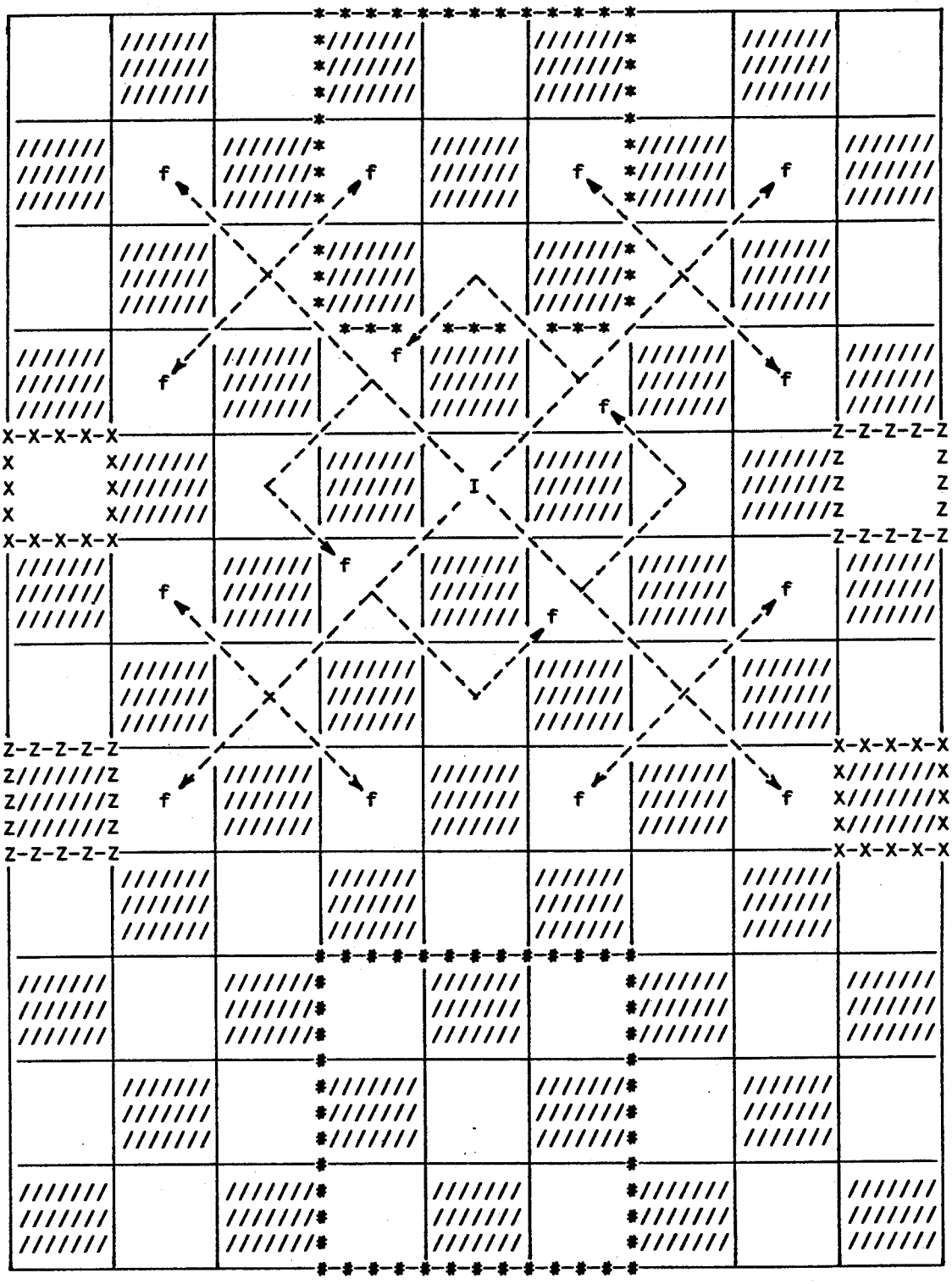
FIG. 6 is a plan view illustration of the movement abilities of a Warrior Maiden and its counterpart, the Unicorn.

Warrior Maiden and Unicorn: The Warrior Maiden possessed great combat skills. She was swift, agile and never feared to combat enemies of greater strength. The Unicorn was a ferocious beast with the body of a horse, feet of an elephant, tail of a boar and the head of a stag. It had a four foot long horn projecting from the top of its forehead. It too was swift, and attacked with its horn and horrible bray. As illustrated in FIG. 6, the agility of both are displayed in their ability to move three (3) squares in any continuous diagonal (either shaded or unshaded squares) direction and *over* any other playing piece(s).

Figure 7:
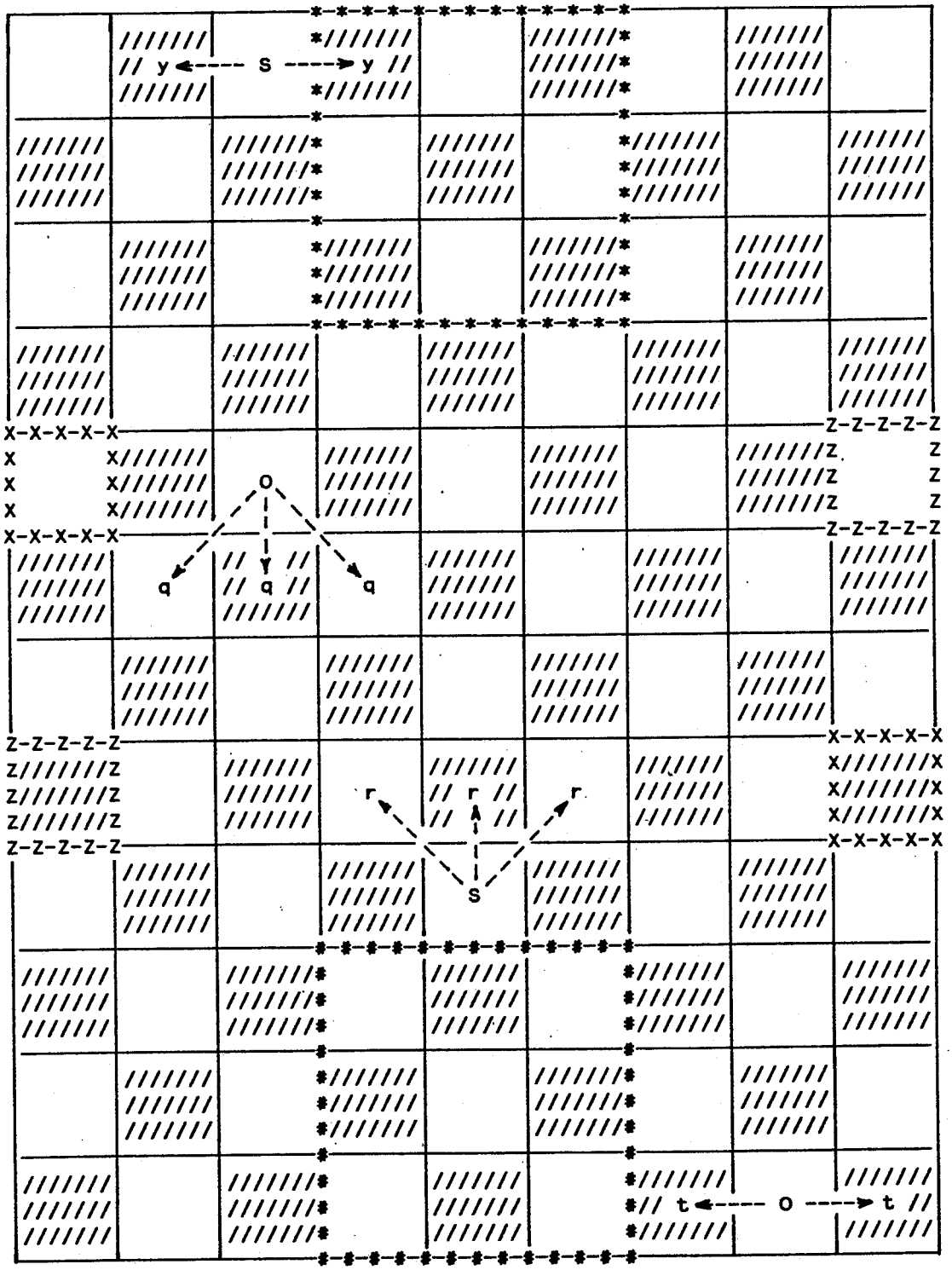
FIG. 7 is a plan view illustration of the movement abilities of a Soldier and its counterpart, the Ogre.

Soldiers and Ogres: The Soldiers were brave warriors highly competent in the use of their spears and swords. They were relentless when ordered to attack the enemy. The Ogre was a giant of enormous strength and sturdiness. It was hairy, had over-exaggerated facial deformities and disproportionately long arms. As illustrated in FIG. 7, the Soldiers and Ogres can only move (and kill its opponents) one square directly or diagonally *forward*.

For their bravery and combat experience, Soldiers are promoted when they reach any square along the Wizard's short edge of the game board. However, these promotions are limited to positions that have been vacated by the King's Warriors killed in battle. The promotion is performed by replacing the Soldier with the selected piece. Likewise, the Ogre may be transformed to any previously destroyed beast when it reaches any square along the King's short edge of the game board.

Rules of the Game

1. Prior to beginning the game, the King's Warriors and the Wizard's Beasts shall be positioned on the game board in accordance with FIG. 1.

2. With the Wizard making the initial attack, the players will take alternate turns moving one of their respective playing pieces. Players *must* move a piece on their turn regardless of the consequences.

3. Playing pieces may only be moved in accordance with their respective ability levels and to a square that is *not* occupied by a playing piece of the same side.

4. The King and the Wizard may only move within their respective castle or cave—until it has killed at least thirteen of its opponent's army.

5. Players may *kill* opposing playing pieces by moving one of their own playing pieces into the square occupied by the target playing piece.

6. A player's turn ends when a legitimate playing piece has been moved and released.

7. A player may delay the promotion of a Soldier or the transformation of an Ogre until the desired replacement (killed in battle) playing piece become available. In the interim, the Soldier's or Ogre's ability is limited to moving laterally along the short edge of the game board. See FIG. 7.

8. A playing piece can *enter* a tunnel only if it has been moved onto the tunnel square in accordance with its ability. Once it has been moved onto the square, it may be left there or moved onto the square at the opposite end of the same tunnel *on the same turn*. See FIG. 8.

9. A playing piece sitting on a tunnel square has two options:

a) move onto the square at the opposite end of the same tunnel or, b) move onto the main battlefield in accordance with its ability level.

Figure 8:
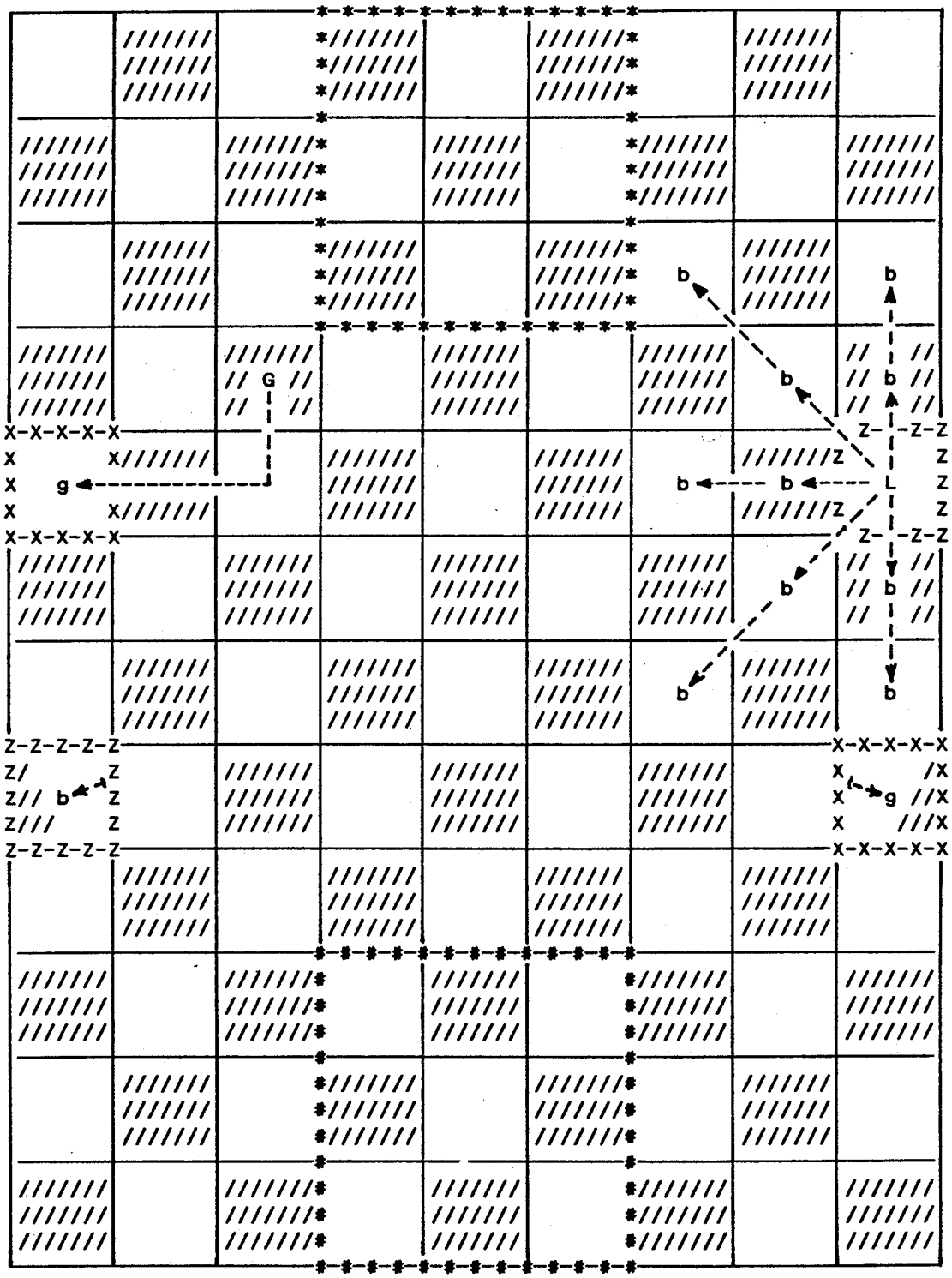
FIG. 8 is a plan view illustration of the movement abilities of two typical playing pieces entering and exiting the two separate tunnels.

See FIG. 8.

10. The "Power Level" of a player is the sum of the values of each player's active playing pieces. The value of each playing piece is as follows:

| | |
|---|---|
| King and Wizard | 30 flames |
| Lord and Dragon | 5 flames |
| Archer and Chimera | 4 flames |
| Knight and Gryphon | 3 flames |
| Warrior Maiden and Unicorn | 2 flames |
| Soldier and Ogre | 1 flame |

"Power Levels" are indicators of the relative performace of each player at any point of time in the game. Each player begins the game with a "Power Level" of sixty (60) flames.

11. If the King or the Wizard can be killed by and on its opponent's next turn, it is said to be in "jeopardy". The King or Wizard under attack must therefore make a countermove out of jeopardy if the battle is to continue. It is *not* mandatory for the attacker to announce the "jeopardy".

12. Either player has the option to declare "jeopardy" when the King or the Wizard is under attack. Upon the declaration of "jeopardy", the attacker has the additional option to end the battle by continuously placing the defender in jeopardy on the attackers next three consecutive turns; or end the jeopardy by discontinuing the attack prior to the aforementioned. When a battle ends on account of the jeopardy rule, the player with the highest "Power Level" at that point will be declared the winner of the game. "Jeopardy" may be declared as many times as the situation arises.

13. The game ends when the King or Wizard has been killed, there is a "jeopardy win", a forfeit, or a draw is mutually agreed upon.

14. In tournament play, the "Power Level" system can be used to determine the champion and ranking of competitors. For example, if ten competitors each played nine games against each of the other competitors, the player with the highest cumulative "Power Levels" of all games won and lost shall be declared the champion. Tie-breaker games may be required.

Strategies

Figure 9:
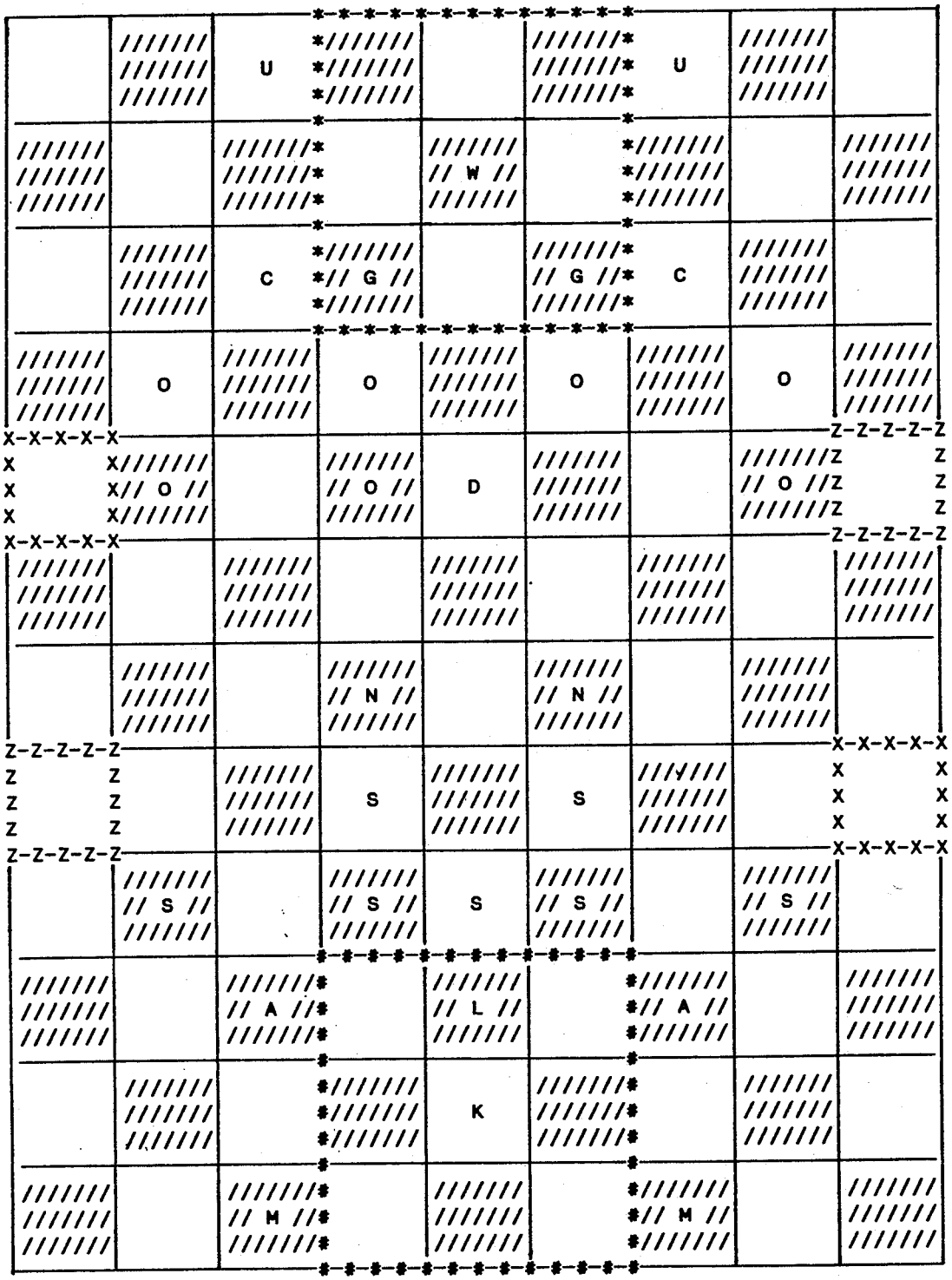
FIG. 9 is a plan view illustration of one of many possible combinations of moves after four full turns of play.
Figure 10:
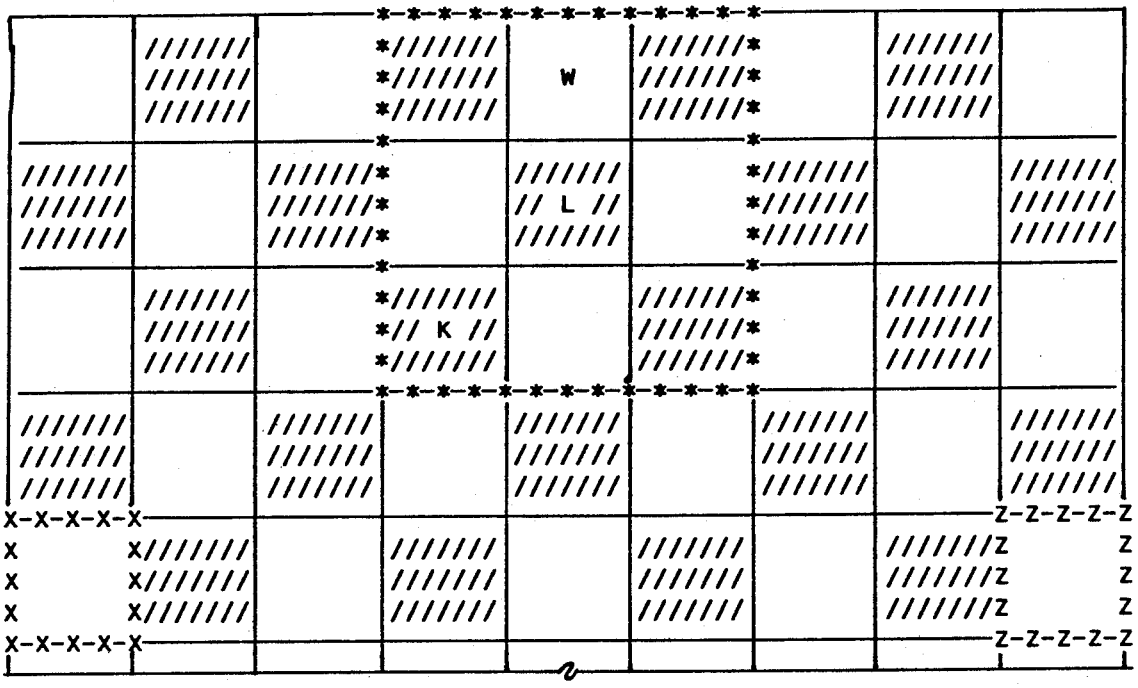
FIGS. 10 through 20 are plan view illustrations of selected winning combinations of playing pieces and their positioning.
Figure 10:
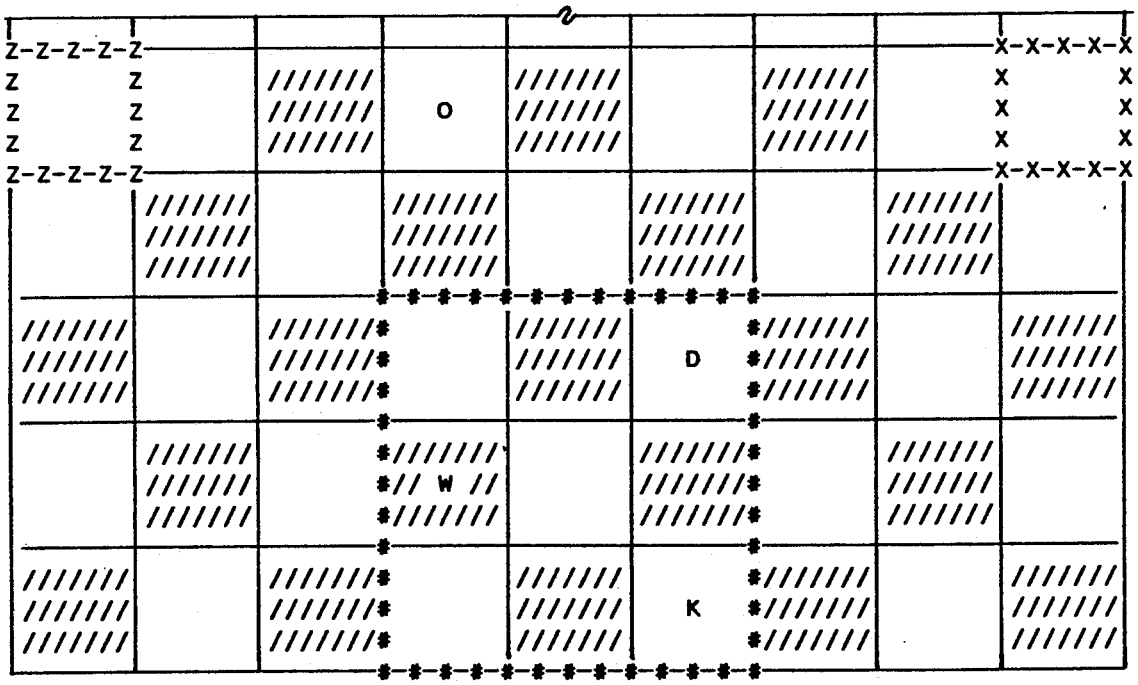
Figure 11:
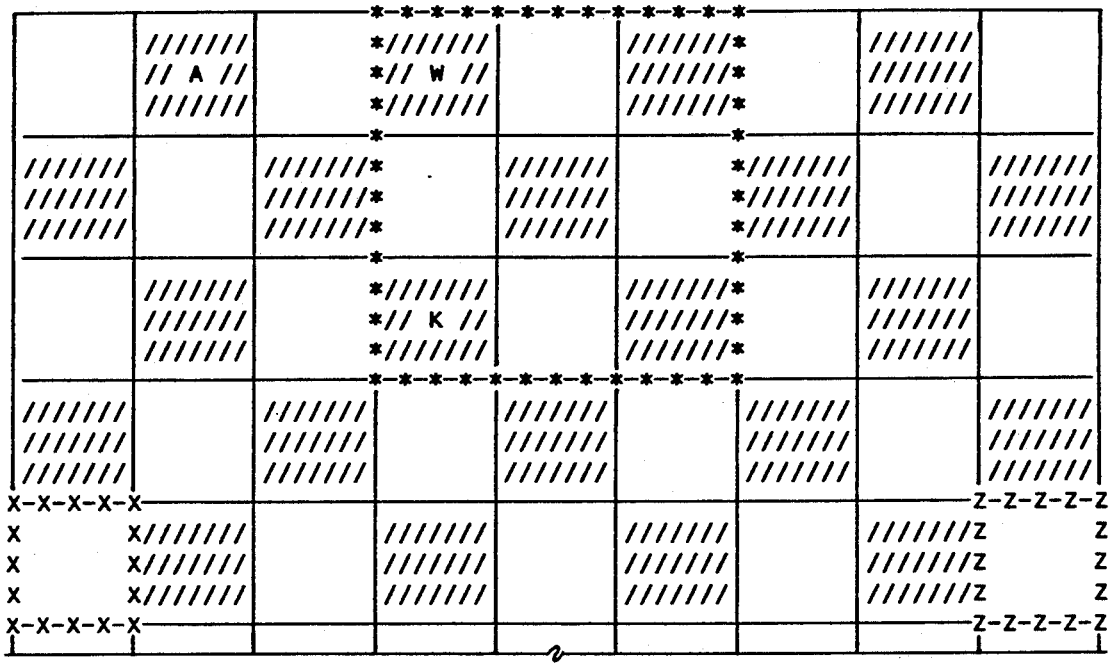
Figure 11:
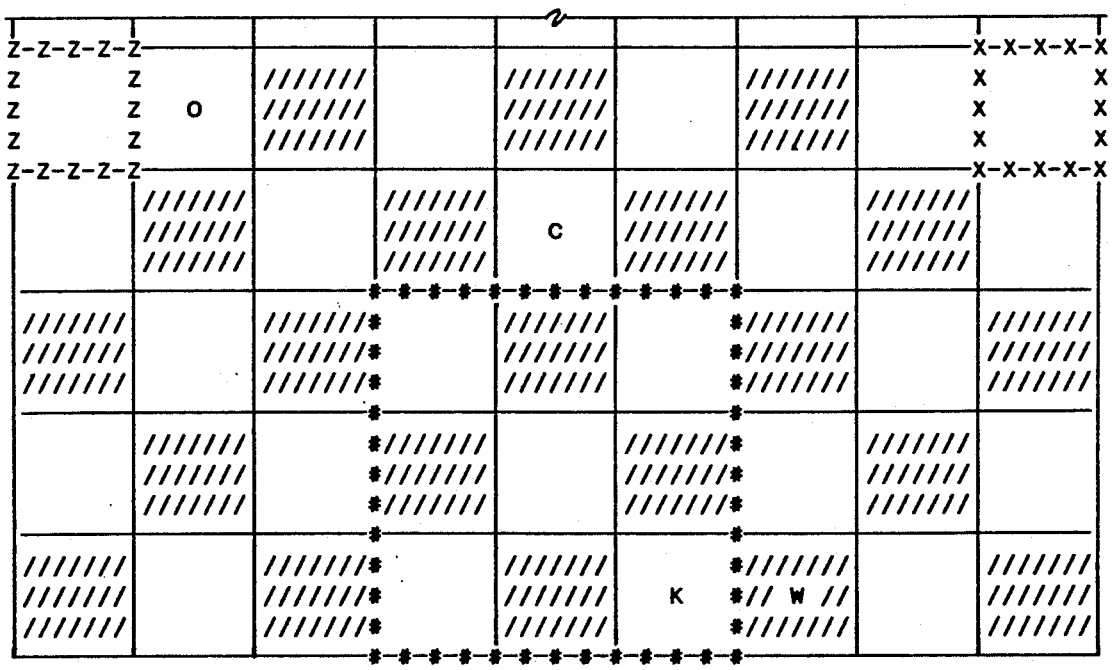
Figure 12:
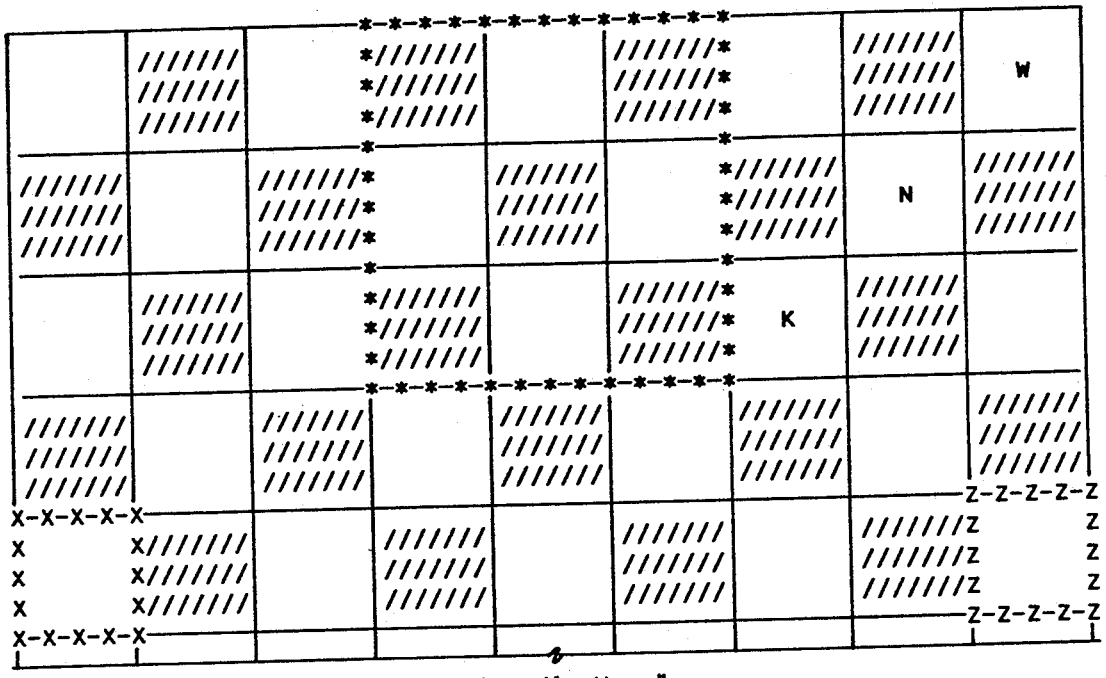
Figure 12:
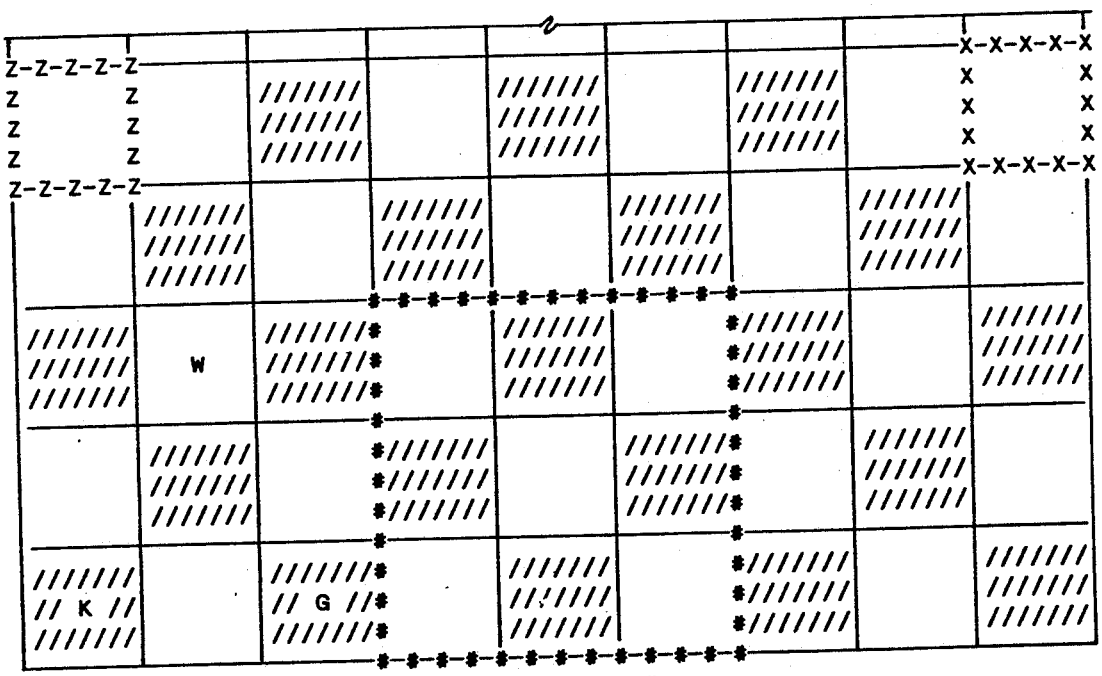
Figure 13:
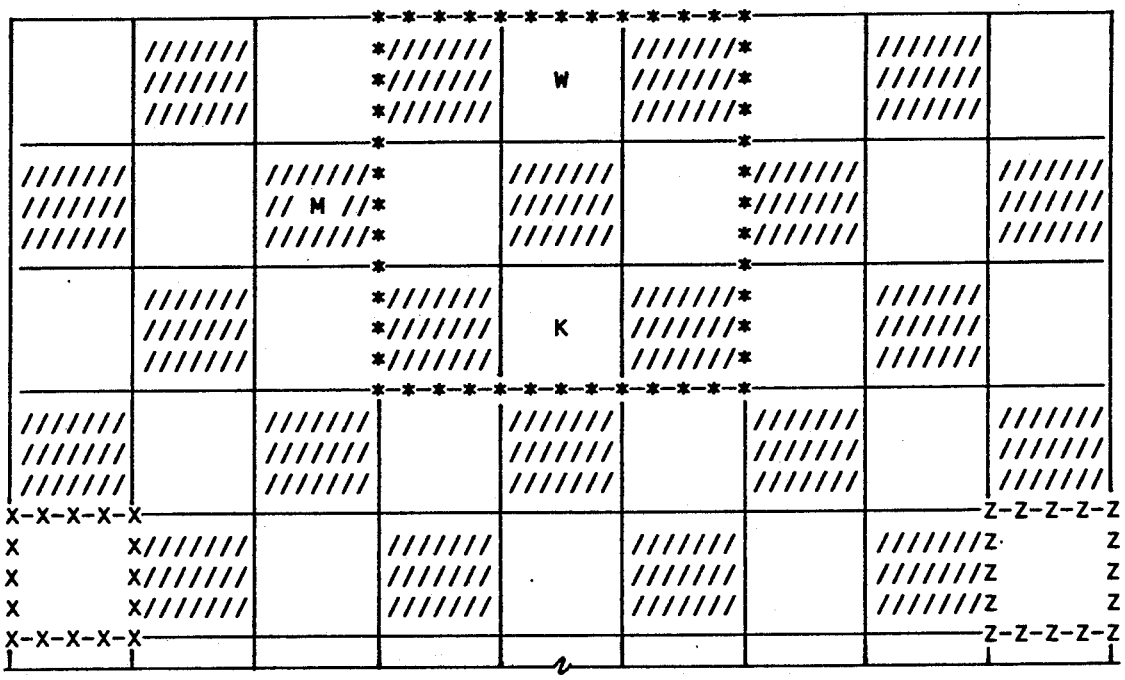
Figure 13:
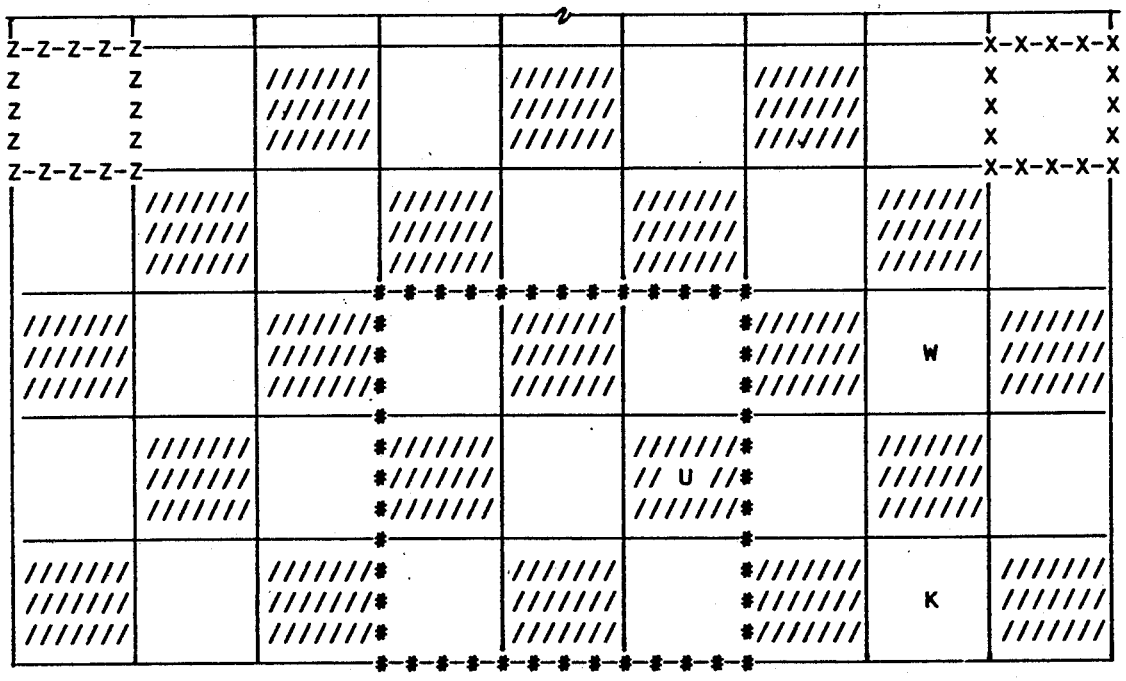
Figure 14:
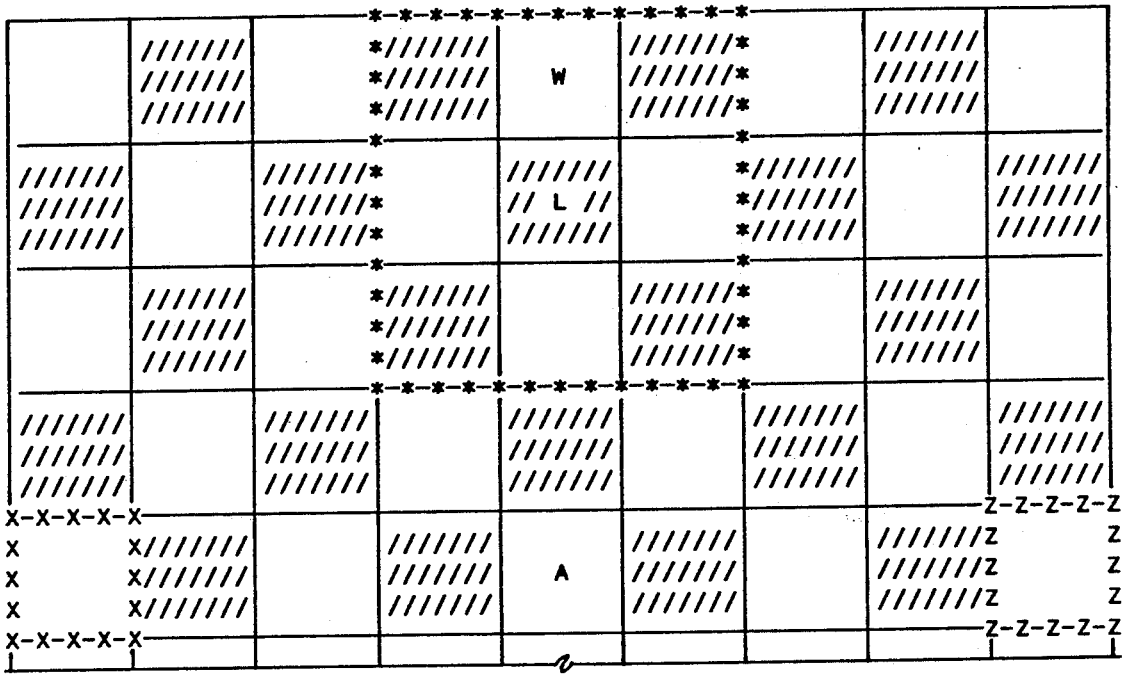
Figure 14:
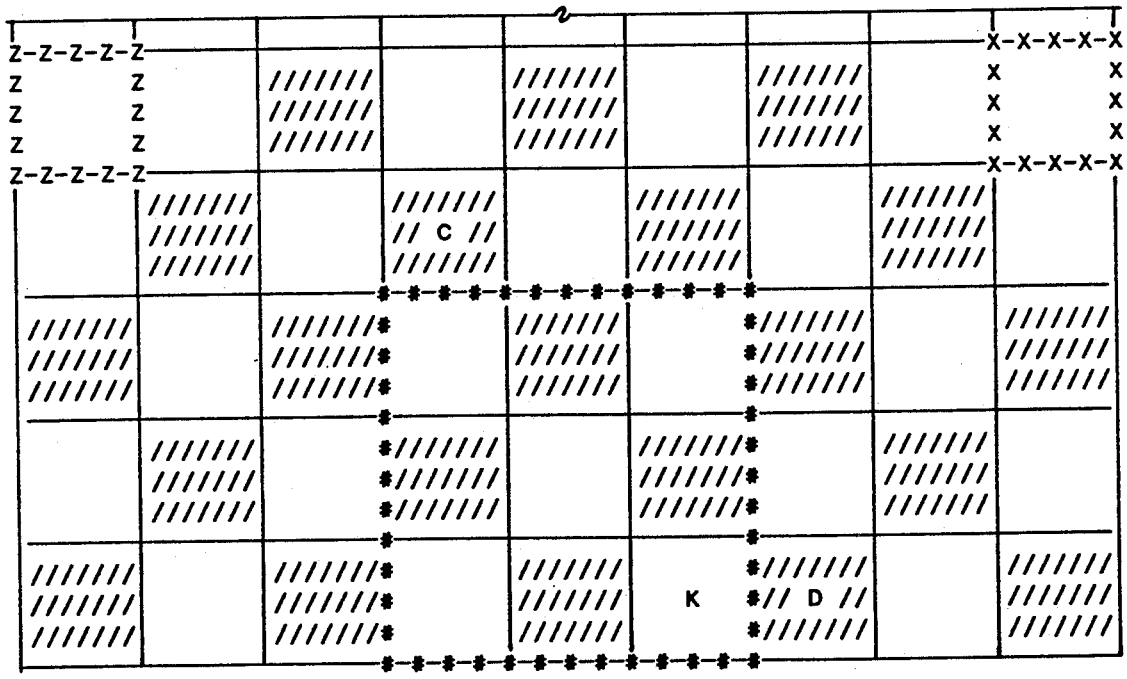
Figure 15:
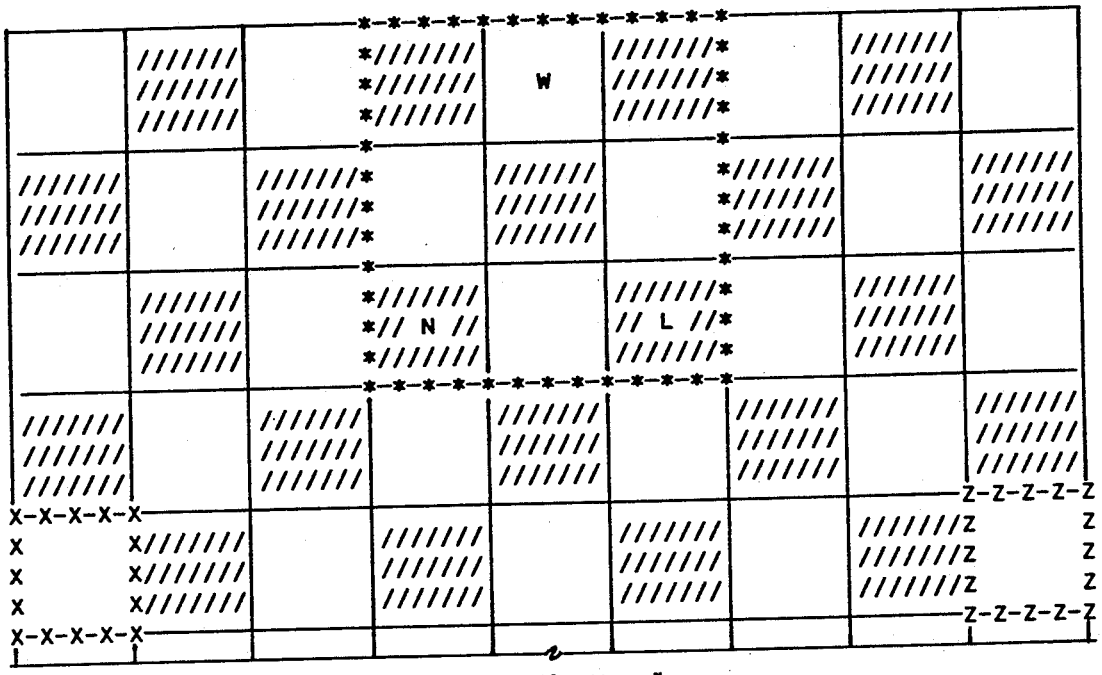
Figure 15:
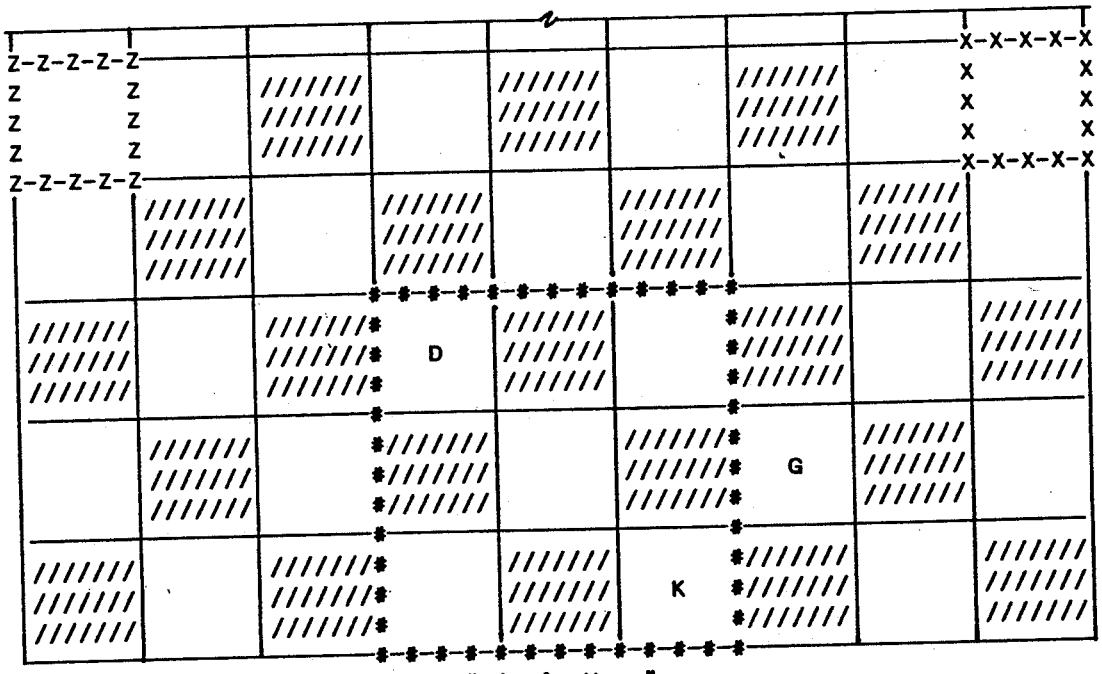
Figure 16:
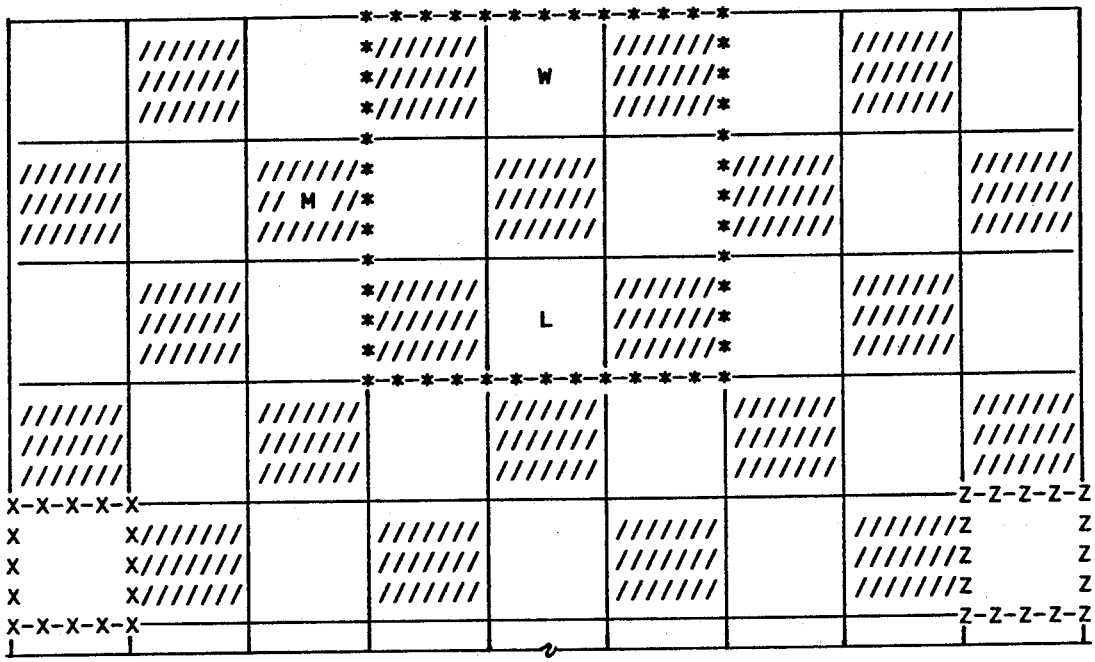
Figure 16:
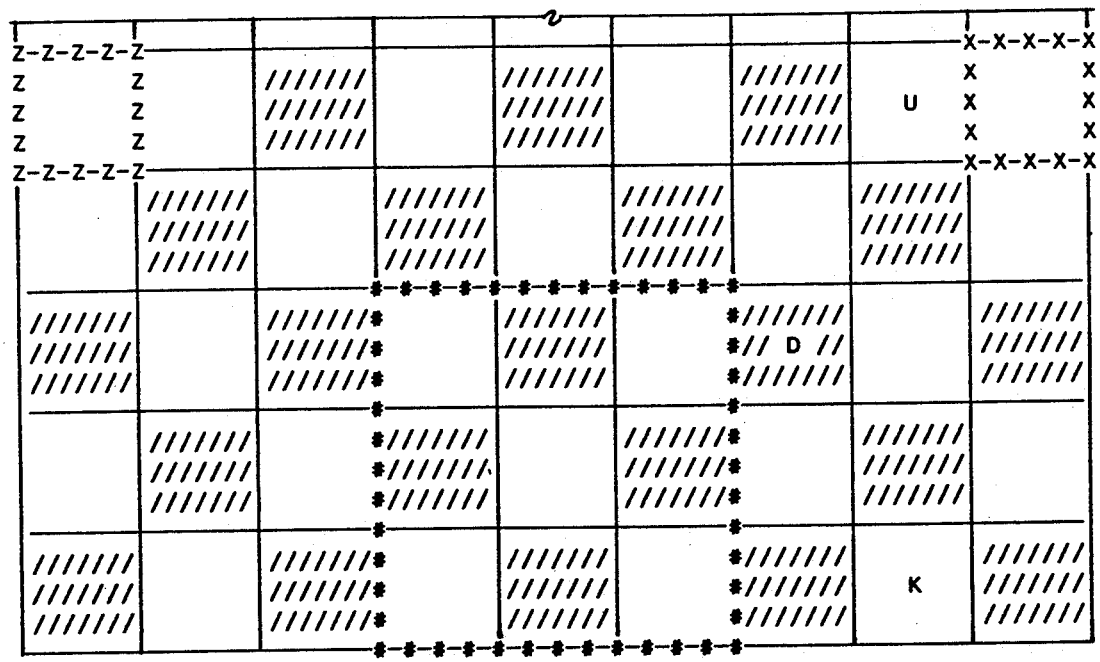
Figure 17:
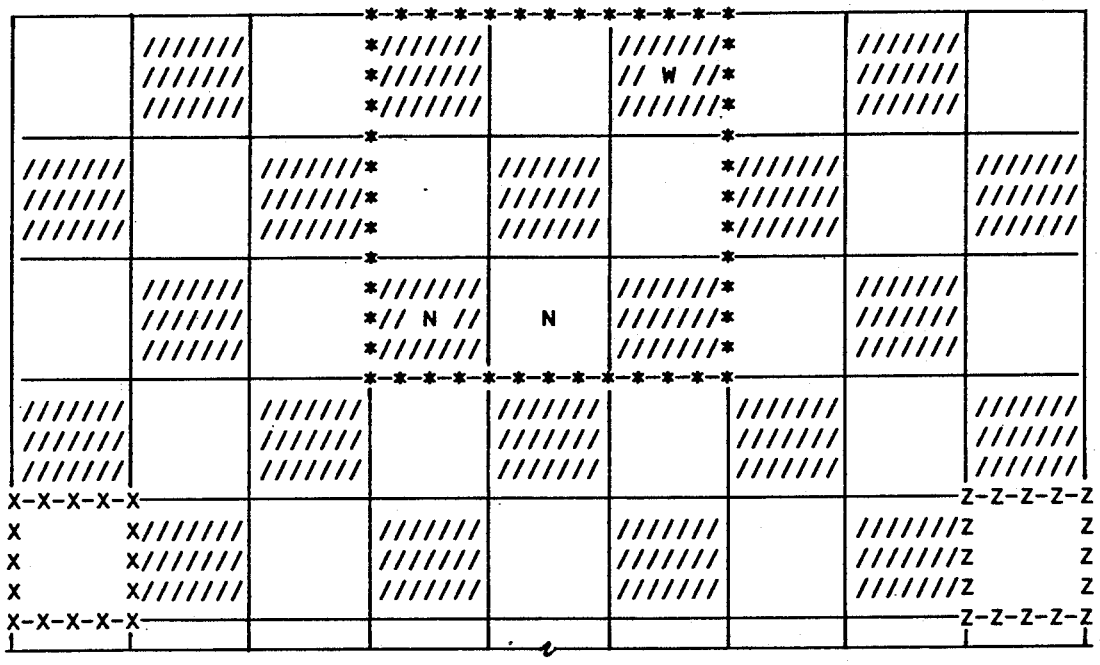
Figure 17:
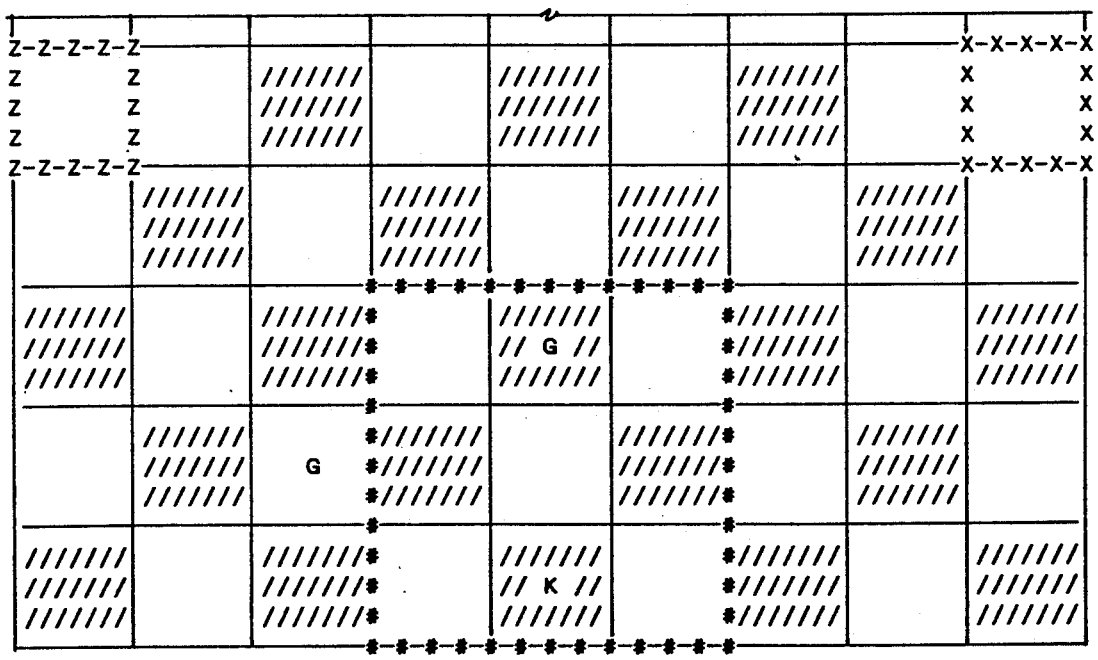
Figure 18:
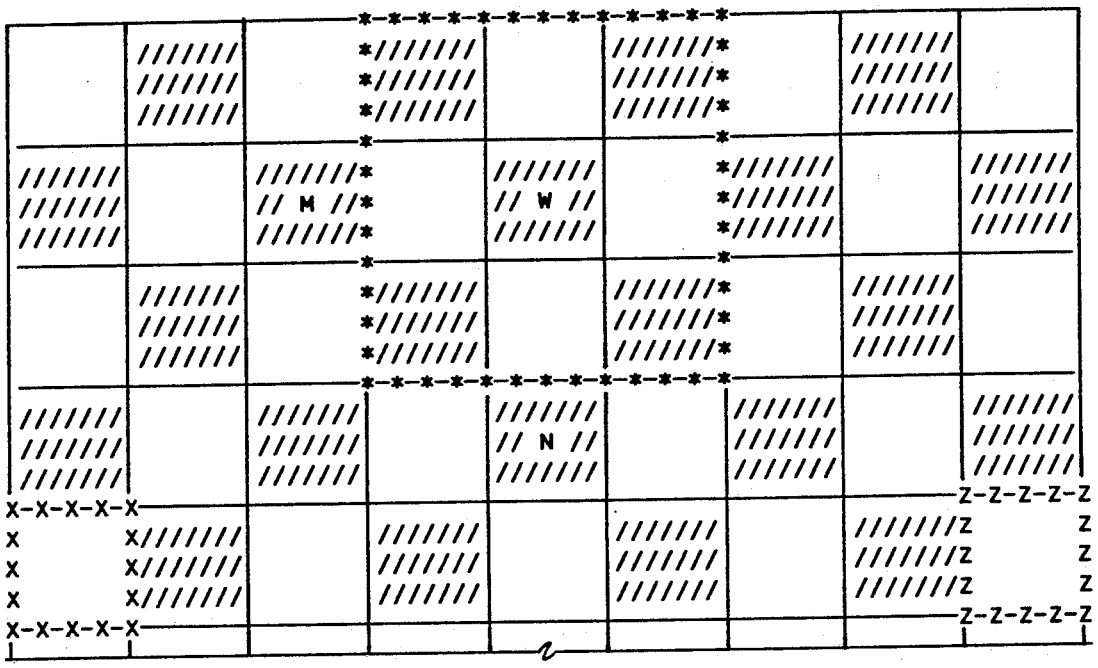
Figure 18:
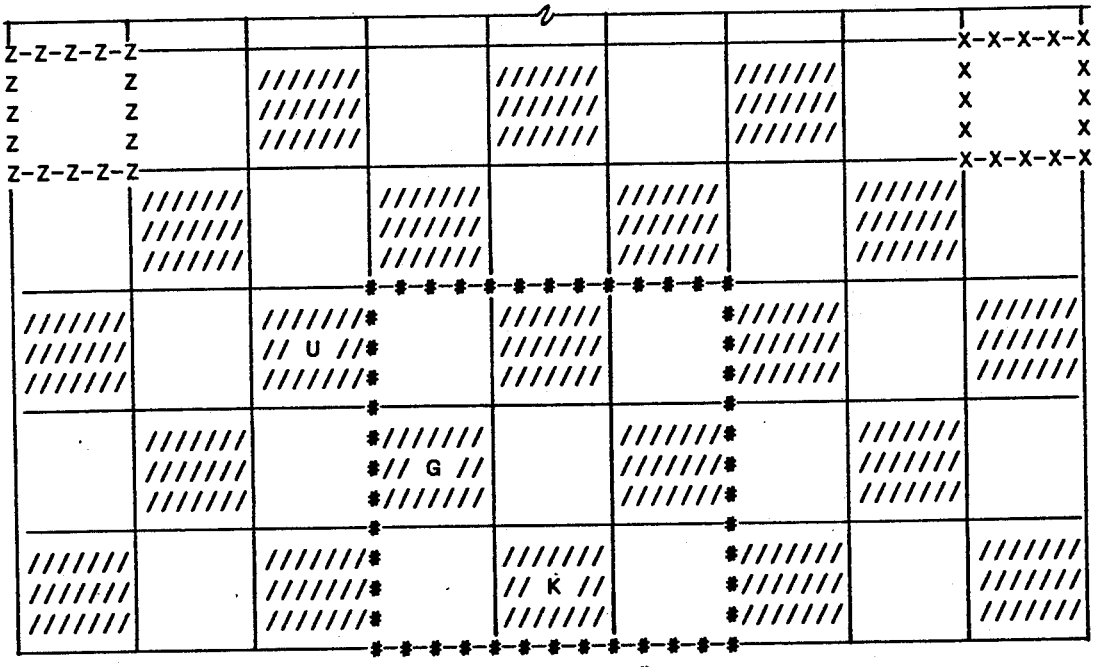
Figure 19:
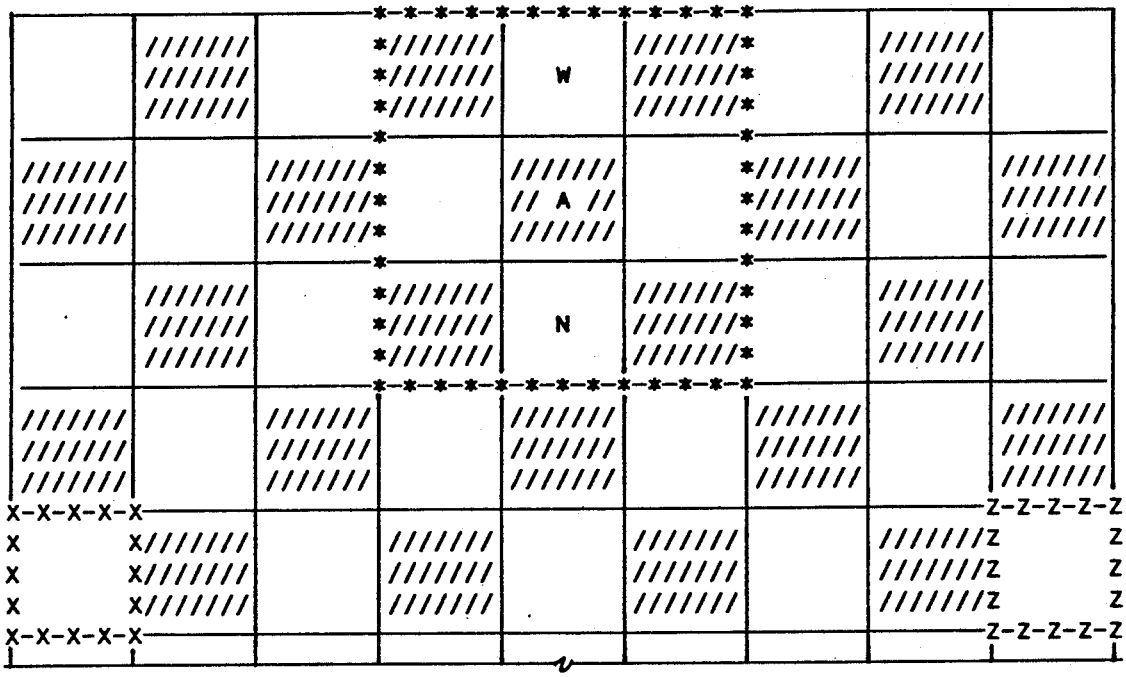
Figure 19:
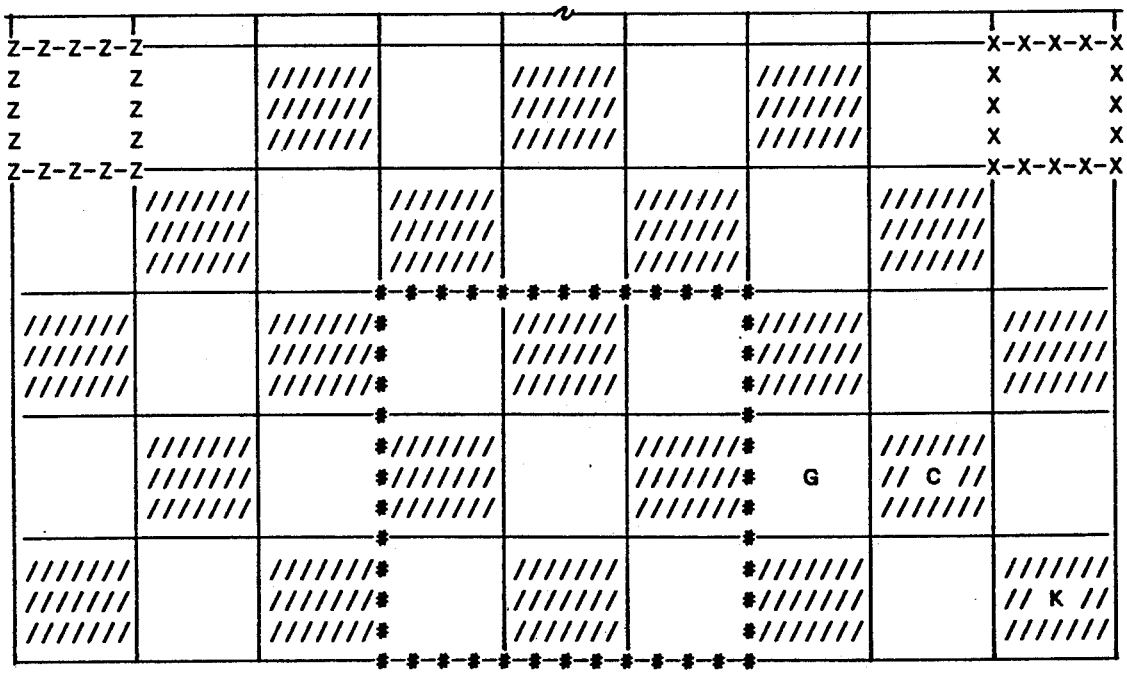
Figure 20:
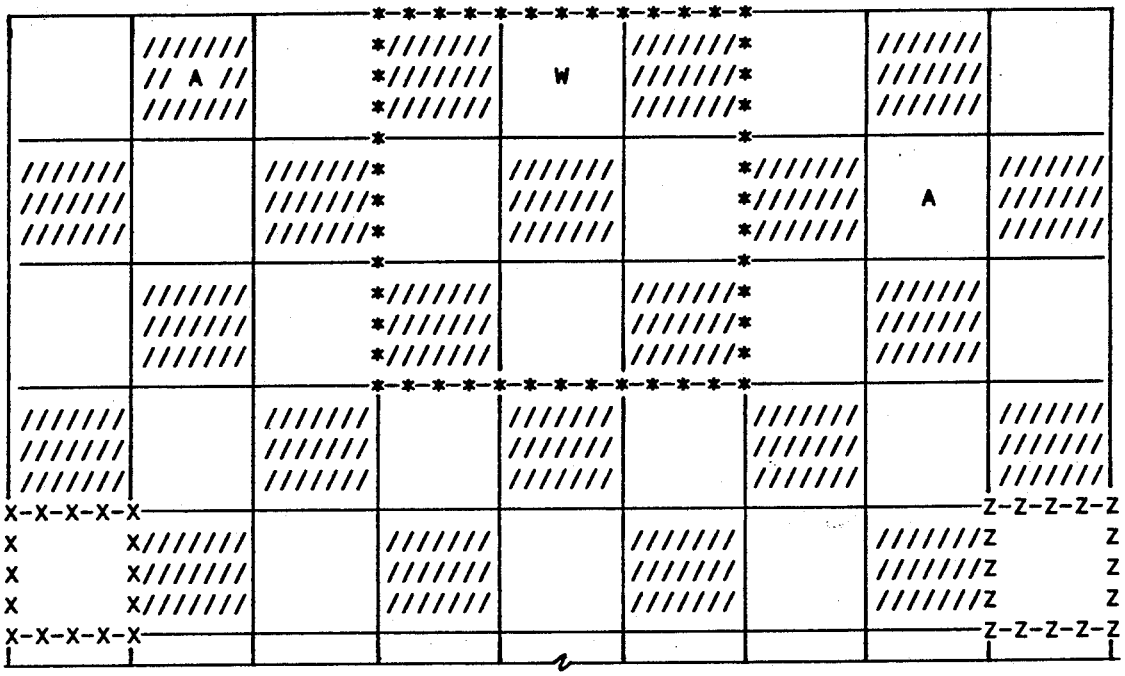
Figure 20:
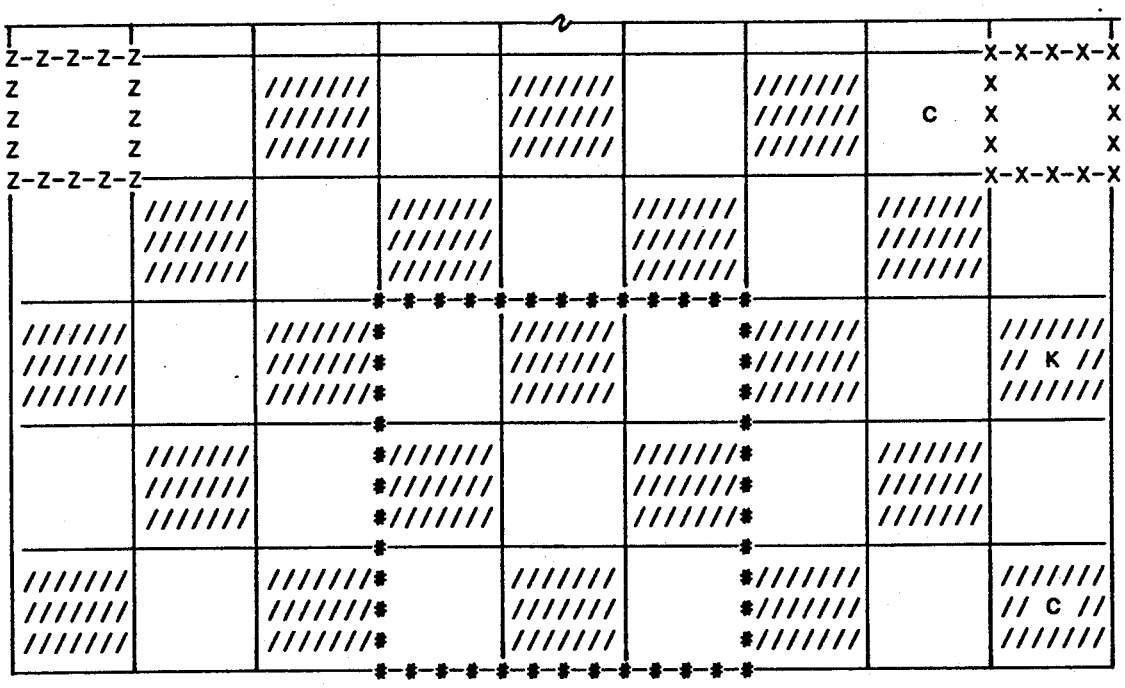

1. Do not underestimate the importance of the Soldiers and the Ogres. For example, FIG.9 illustrates how the Soldiers and the Ogres have been strategically positioned after four moves by each player. The Ogres have been positioned to provide two rows of defense and at the same time provide an offensive path for the Chimeras and the Dragon. Similarly, the Soldiers have been moved to provide a path for the Archers and at the same time reinforce the positions of the offensive Knights.

2. At the beginning of the battle, it may be wise to leave a couple of Soldiers and/or Ogres in position to guard the tunnel ingresses/egresses.

3. If necessary, the Warrior Maiden's and/or Unicorn's travel path may be changed from shaded squares to unshaded squares (and vice versa) simply by passing through a tunnel.

4. In order to win the battle, it will many times be necessary for a player to have at least one Warrior in addition to the King; or one Beast in addition to the Wizard. FIGS. 10 through 20 illustrate various winning combinations of playing pieces and their strategic positions. There are numerous other possibilities.

5. Player's should monitor their "Power Levels" at all times to determine if they should pursue or avoid a "jeopardy" win or loss.

Having described the present invention in detail, it is obvious that the present invention can provide an enormous amount of intellectual challenge and entertainment for anyone of reasonable age and intellectual capacity. The present invention can also be expanded to three dimensional play.

What is claimed is:

1. A method of playing a strategic board game comprising the steps of:

a. providing a game board, said board representing a battlefield and comprised of a plurality of spaces arranged in plurality of perpendiculary intersecting rows and columns arranged in a rectangle; of which eighteen of the said spaces, or two sets of nine spaces (arranged three by three) located and centered off each of the short sides of the game board are delineated to represent a King's castle and a Wizard's cave; providing at least one first space located adjacent a first long side of the board, and providing at least one second space located adjacent a second long side of the board opposite said first long side, at least one first space corresponding to said at least one second space, and said spaces delineated to represent the ingresses/egresses of at least one tunnel;

b. providing a plurality of playing pieces, said playing pieces divided into a first and a second set of playing pieces, said first set of playing pieces representing King, a Lord, an Archer, a Knight, a Warrior Maiden and a Soldier, said second set of playing pieces representing a Wizard, a Dragon, a Chimera, a Gryphon, a Unicorn and an Ogre all of distinguishable shapes and color(s);

c. providing predetermined movement abilities to each playing piece;

assiging said first set of playing pieces to a first player, and assigning said first set of playing pieces to a second player;

positioning said playing pieces on the spaces of said board:

players, in turn, moving one of their playing pieces according to its predetermined movement abilities;

moving a playing piece onto said first or second space in accordance with its ability; optionally leaving said playing piece on said first or second space or moving said playing piece onto said corresponding second or first space at the opposite long side of the board on the same turn; if said player moves said playing piece to said second or first corresponding space, said played optionally leaving said playing piece on said corresponding space or said player moving said playing piece off said corresponding square and moving said playing piece to said main battlefield according to its predetermined movement ability.

2. A method of playing of strategic board game comprising the steps of:

a. providing a game board, said board representing a battlefield and comprised of a plurality of spaces arranged in a plurality of perpendicularly intersecting rows and columns arranged in a rectangle; of which eighteen of the said spaces, or two sets of nine spaces (arranged three by three) located and centered off each of the short sides of the game board are delineated to represent a King's castle and a Wizard's cave;

b. providing a plurality of playing pieces, said playing pieces divided into a first and second set of playing pieces, said first set of playing pieces representing a King, a Lord, an Archer, a Knight, a Warrior Maiden and a Soldier, said second set of playing pieces representing a Wizard, a Dragon, a Chimera, a Gryphon, a Unicorn and an Ogre all of distinguishable shapes and color(s);

c. providing predetermined movement abilities to each playing piece;

assigning said first set of playing pieces to a first player, and assigning said second set of playing pieces to a second player;

positioning said playing pieces on the spaces of said board;

players, in turn, moving one of their playing pieces according to its predetermined movement abilities; said predetermined movement abilities comprising:

when a playing piece lands on a space occupied by an opposing playing piece, said opposing playing piece is removed from the board;

limiting the movement of said King and Wizard pieces only within their respective castle or cave, until a respective set of playing pieces have removed at least thirteen pieces from an opponent's set of playing pieces;

moving said Lord and Dragon pieces one or two spaces on a straight line in any direction without jumping over said other playing pieces;

moving said Archer and Chimera pieces one, two, three, or four spaces in any horizontal or vertical direction only without jumping over said other playing pieces;

moving said Knight and Gryphon pieces three spaces in any continuous horizontal and/or vertical direction and over any other playing piece or pieces;

moving said Warrior Maiden and Unicorn pieces three spaced in any continuous diagonal direction and over any other playing piece or pieces;

moving said Soldier and Ogre pieces one space directly or diagonally forward.

* * * * *